US010180012B1

(12) United States Patent
Minson et al.

(10) Patent No.: US 10,180,012 B1
(45) Date of Patent: Jan. 15, 2019

(54) INSECT BIVY

(71) Applicants: Matthew Alan Minson, Spring, TX (US); Kelli L. Minson, Spring, TX (US)

(72) Inventors: Matthew Alan Minson, Spring, TX (US); Kelli L. Minson, Spring, TX (US)

( * ) Notice: Subject to any disclaimer, the term of this patent is extended or adjusted under 35 U.S.C. 154(b) by 0 days.

(21) Appl. No.: 15/059,832

(22) Filed: Mar. 3, 2016

(51) Int. Cl.
*E04H 15/20* (2006.01)
*E04H 15/32* (2006.01)
*A45F 4/00* (2006.01)
*E04H 15/34* (2006.01)

(52) U.S. Cl.
CPC ..... *E04H 15/20* (2013.01); *A45F 4/00* (2013.01); *E04H 15/32* (2013.01); *E04H 15/34* (2013.01)

(58) Field of Classification Search
CPC ..... E04H 15/20; E04H 15/34; E04H 15/56; E04H 2015/201; E04H 2015/206; E04H 2015/202; E04H 2015/208; E04H 15/32; E04H 2015/204; A45F 4/00; A45F 4/04; A47C 29/006; A47C 27/081; A47G 9/086
USPC ..... 135/121, 124, 137, 116, 115; 5/414, 5/413 AM; 52/2.18, 2.23
See application file for complete search history.

(56) References Cited

U.S. PATENT DOCUMENTS 2,875,771 A 3/1959 Brewin
3,145,719 A * 8/1964 Johnson ..... E04H 15/20 52/2.21
3,161,553 A 12/1964 Visser
3,840,919 A 10/1974 Middleton
3,860,980 A 1/1975 Ebert
3,899,853 A 8/1975 Wertman
4,103,369 A * 8/1978 Riordan ..... E04H 15/22 4/499
4,531,330 A 7/1985 Phillips
D300,649 S 4/1989 Tauer
4,819,389 A 4/1989 Kihn
5,007,212 A 4/1991 Fritts et al.
5,226,261 A 7/1993 Wilbourn et al.
5,396,674 A * 3/1995 Bolds ..... A47C 20/027 5/630
5,487,400 A * 1/1996 Dawkins ..... E04H 15/20 135/124

(Continued)

FOREIGN PATENT DOCUMENTS

JP 07324522 A 12/1995
JP 02000320191 11/2000
JP 2000336977 A 12/2000

*Primary Examiner* — Winnie Yip
(74) *Attorney, Agent, or Firm* — Davidson Berquist Jackson & Gowdey LLP

(57) ABSTRACT

An individual sized, sleeping bivy in the form of a lightweight, self-supporting, personal shelter that provides protection from bug bites and stings and, more particularly, concerns a personal shelter sized for an individual regardless of whether that individual is a child or a grown adult male to prevent illness and death, especially among children. The bivy includes an endoskeleton or frame overlaid and integrated with mosquito netting, and includes a flooring member connected to the endoskeleton. The endoskeleton is preferably, but not necessarily, an inflatable structure or a self-rising structure that can be collapsed into a small package suitable for easy carrying, for mass distribution, or to be supplied via airdrops.

17 Claims, 8 Drawing Sheets

(56) References Cited

U.S. PATENT DOCUMENTS

| | | | | | |
|---|---|---|---|---|---|
| 5,562,115 | A * | 10/1996 | Sotelo | A45F 4/04 | 135/100 |
| 5,570,544 | A * | 11/1996 | Hale | E04H 15/20 | 52/2.11 |
| 5,660,197 | A * | 8/1997 | Boe | A47C 27/081 | 135/116 |
| 5,860,251 | A * | 1/1999 | Gleich | A62C 3/0257 | 52/2.18 |
| 5,893,237 | A | 4/1999 | Ryon et al. | | |
| 5,987,822 | A | 11/1999 | McNiff | | |
| 6,260,306 | B1 | 7/2001 | Swetish et al. | | |
| D482,423 | S | 11/2003 | Newsome | | |
| 6,708,451 | B1 | 3/2004 | Gomes | | |
| 6,848,460 | B2 * | 2/2005 | Zheng | E04H 15/40 | 135/126 |
| 6,858,054 | B2 * | 2/2005 | Page | A61L 9/16 | 135/93 |
| 6,929,016 | B2 | 8/2005 | Lee | | |
| 8,011,986 | B1 | 9/2011 | Curtsinger | | |
| 8,079,182 | B1 | 12/2011 | Higgins | | |
| 8,166,711 | B2 * | 5/2012 | Lamke | E04H 15/20 | 135/135 |
| 2006/0021643 | A1 * | 2/2006 | Brensinger | E04H 15/56 | 135/90 |
| 2012/0031448 | A1 * | 2/2012 | Brensinger | A61G 1/04 | 135/121 |

* cited by examiner

INSECT BIVY

COPYRIGHT NOTICE

A portion of the disclosure of this patent document contains material that is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to a lightweight, self-supporting, personal shelter that provides protection from bug bites and stings and, more particularly, concerns a personal shelter sized for an individual regardless whether that individual is a child or a grown adult male.

INTRODUCTION

Zoonotic illness is defined as requiring an animal vector. This generally involves insects and the transmission of a parasite or infectious agent via a bite to a human. This includes but is not limited to malaria, filiariasis, Chaga's disease, dengue, Zika, yellow fever, West Nile Virus, and more. Regardless of the strategy one might use for the prevention and treatment of these illnesses, barrier protection and limitation of bite potential is fundamental and needed in many parts of the world.

SUMMARY OF THE INVENTION

The main objective of the present invention is to provide such barrier protection in the form of a light-weight, portable enclosure which is capable of protecting the user against insect bites and stings when sleeping outdoors, and to have a main endoskeleton that will support insect netting away from a sleeping individual, with the endoskeleton being preferably a collapsible structure yet be a self-rising structure, or an inflatable or fluid or expandable material type of supporting structure.

Glossary: As used throughout this document the word "bivy" shall mean any form of individual enclosure, bivouac sack, or a form of a lightweight, waterproof shelter, and should not be considered as and is distinguishable from a tent or a tent type structure. A bivy can used by adults, children, climbers, mountaineers, hikers, ultra-light back packers, soldiers, humanitarian aid workers, soldiers, minimalist campers and by individuals in parts of the world where the environment is highly insect infested and where children and adults would benefit from a personal form of light weight, readably available shelter that will provide a barrier to bites from such insects while maximizing protection, but minimizing storage and carrying requirements. As used herein bivy it is also important that such a bivy be a structure that is collapsible into a very small light weight bundle, for example, the size and weight of a football, so that many hundreds of them can be packed into airplane droppable pallets for mass distribution, for example, in third world countries or undeveloped areas or under-developed nations areas, territories or places, in jungle environments, or the like. The bivouac sac or bivy has a larger, similar counterpart, called a bivouac shelter. The functional aspect of this application's bivy is that unlike a tent it configures more closely to the anatomical shape of an individual. It also allows air to pass through, for tropical or climatically warm situations, while preventing entry of the offending zoonotic vectors for example, like mosquitoes, midges, and no-see-ums, thus making it an effective disaster, remote, at risk, or austere environment shelter option. Further, the protective mosquito netting needs to be maintained some distance from and out of contact with the occupant's body so that the insects cannot reach the individual within an erected bivy.

DESCRIPTION OF PRESENTLY PREFERRED EXAMPLES OF THE INVENTION

Brief Description of Figures

The invention is better understood by reading the following detailed description with reference to the accompanying drawings in which.

DETAILED DESCRIPTION OF PREFERRED EMBODIMENTS

A. Overview

Figure 1:
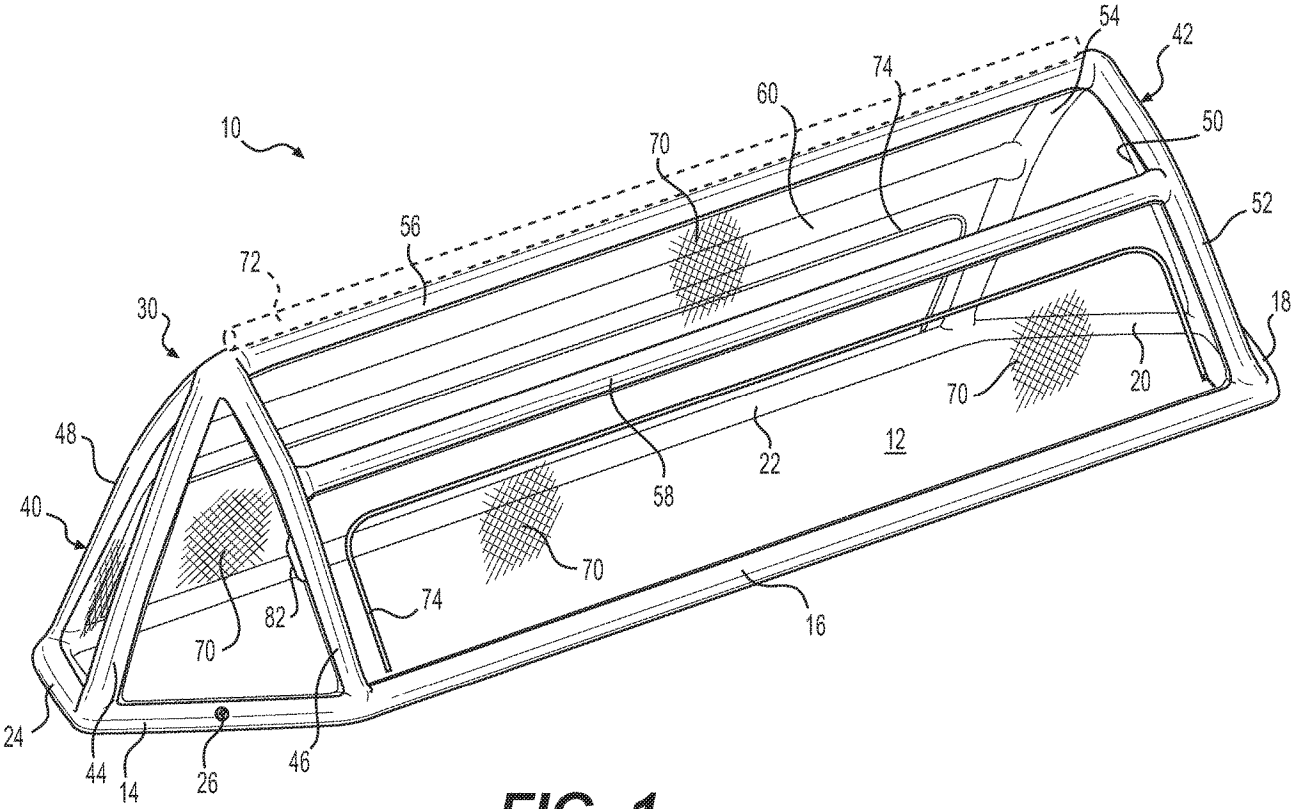
FIG. 1 is a perspective view of an embodiment of the present invention.

To gain a better understanding of the invention, a preferred embodiment will now be described in detail. Frequent reference will be made to the drawings. Reference numerals or letters will be used throughout to indicate certain parts or locations in the drawings. The same reference numerals or letters will be used to indicate the same parts and locations throughout the drawings, unless otherwise indicated.

B. Environment

The present invention concerns the prevention of insect borne and small creature borne infectious diseases as noted above by providing an individual sized, sleeping bivy composed of an endoskeleton or frame overlaid and integrated with mosquito netting. Ideally the mosquito netting would meet CDC and WHO recommendations of pore size and would be treated with permethrin to prevent illness and death especially among children. This would allow air to pass through the shelter while still providing the desired high degree of bite protection. The endoskeleton is preferably, but not necessarily an inflatable structure or a self rising structure.

The preferred embodiment now described will be with respect to an individual sized personal insect bite preventing shelter. The scale of the embodiment, therefore, is to be understood with respect to this type of article. It is to be understood as well, however, that the invention is applicable to other articles and its scale can vary accordingly.

C. Structure

Figure 2:
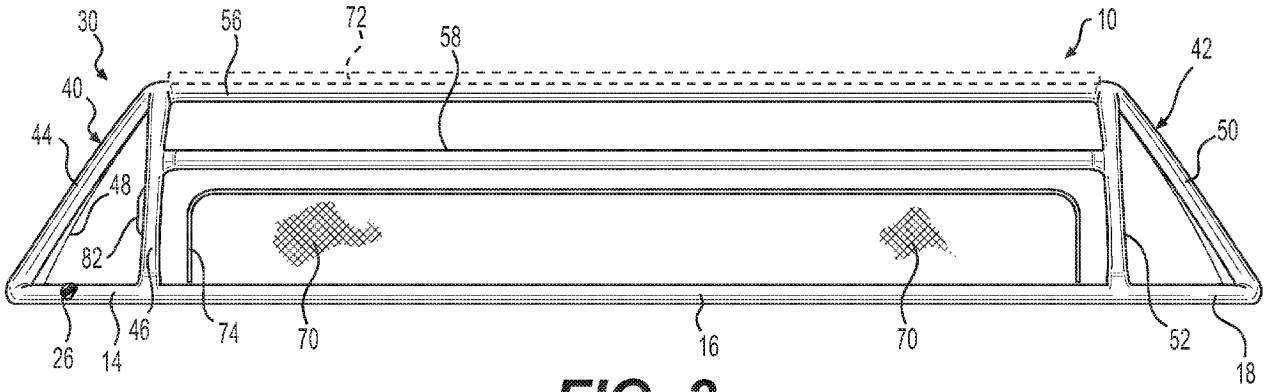
FIG. 2 is a front elevational view thereof.
Figure 3:
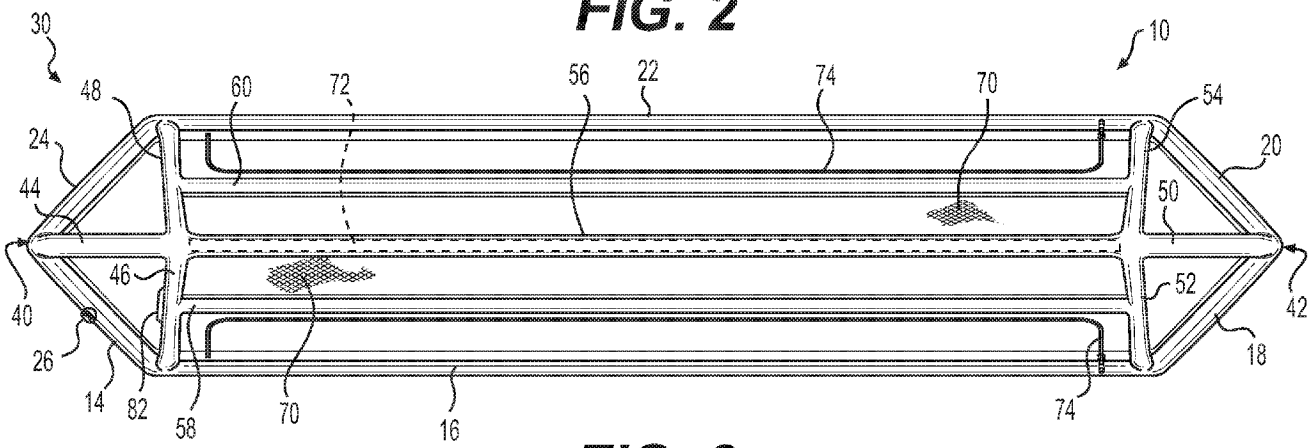
FIG. 3 is a top plan view thereof.

FIGS. 1-3 show a first embodiment of the present invention. The bivy 10 has a bottom or floor member 12 that is preferably water proof and can have a variety of forms. Preferably floor member 12 can be comprised of a plastic material, a coated plastic, a thermoplastic, a sheet of nylon, polyethylene, polypropylene, mylar, polyester, or other applicable or desired material. The material used in constructing floor member 12 can have a thickness ranging from about 10 to about 60 mil, with a preferred thickness of about 30-40 mil. The flooring material 12 is provided with an outer periphery defined by a series of interconnected structures 14-24 that collectively form an upstanding exterior or outer wall about the floor 12 that can have a height of 1 to 3 inches. The structures 14-24 can be connected to the flooring material by any one of a number of approaches including, but not limited to, glue or adhesive, by being heat welded, spot welded, or by other techniques including molding.

The structures 14-24 that extend around floor member 12 could be constructed from a series of interconnected inflatable tubes, and an exterior inflating port 26 can be provided along one of the structures as is shown in the outer periphery section 14. Alternatively, the members 14-24 could be formed from tubes that have been filled with a self-inflating foam, or other memory retaining style or type of material provided therein, or from other forms of tubing, or a thickened wall material that will be equally collapsible into a small package.

The bivy 10 also includes an upper endoskeleton or upper support structure 30 that is attached to floor member 12 by a suitable connection, for example glue/adhesive, sewing, by heat welding or like approaches. The upper endoskeleton or support structure 30 will be formed with two opposing end sections in the form of a three-dimensional pyramidal tripod or triframe 40 and 42. The foremost triframe 40 in FIG. 1 is comprised of a straight end most member 44 and a pair of straight side members 46 and 48. The opposite end's triframe 42 is LAO formed from a straight end most member 50 and its own pair of additional straight side members 52 and 54.

Figure 4:
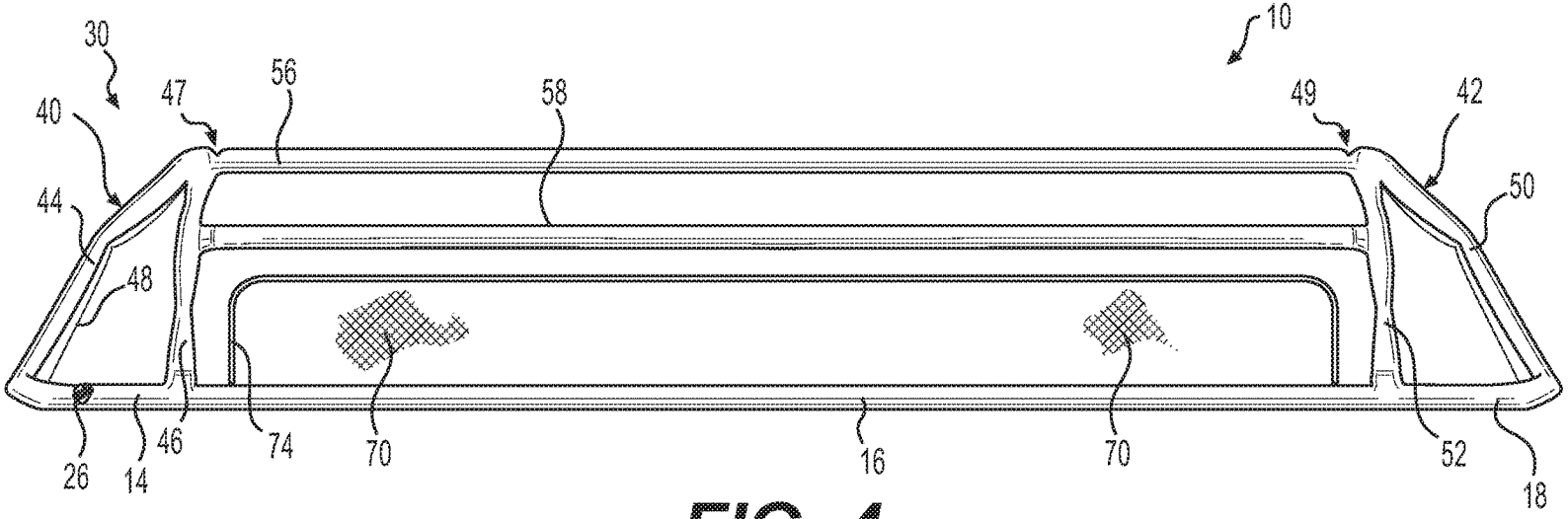
FIG. 4 is a front elevational view showing the shelter in a partial collapsed condition where the top horizontal support member is crimped at its opposite ends.

The present design also allows the top or upper portion of each of the two opposing triframes 40/42 to form or develop a crimped area shown at 47 and 49 in the two opposing triframes 40/42, respectively, as is shown in FIG. 4. This could occur when or if the endoskeleton structure 30 is in an early stage of deflation, for example due to colder air that could cause the inflating air supply within bivy 10 to be reduced. The crimped areas 47/49 are formed from the collapsing of the upper portions of members 44/46/48 of triframes 40 and members 50/52/54 of triframes 42 where they meet with the opposing ends of the top horizontal support member 56. As the opposing crimped areas 47/40 form they will collectively serve to crimp the opposing ends of the top horizontal support member 56 and thereby hold air within the top horizontal support member 56 that will thereby assist in preventing the netting 70 from sagging and gaining a closer proximity to an occupant of the bivy 10.

Extending between the triframes 40 and 42 is a straight horizontally extending top member 56, as shown in FIGS. 1-4, and a pair of additional straight horizontally extending side members 58 and 60 that are located on opposite sides of top member 56. Top member 56 extends between a top portion of each of the triframes 40/42 and will interconnect with the top ends of members 44-48 of triframe 40 and the top ends of members 50-54 of triframe 42 at the opposite end of bivy 10. Each of the side members 58/60 will span horizontally between to opposing legs of the triframe as is shown for side member 58 that spans between triframe members 46 and 52 while side member 60 spans between triframe members 48 and 54. The connection point between the side members 58/60 and the triframe members 48/54 and 46/52, respectively, is preferably located about one third the way down from the top of the length of the triframe members 48/54 and 46/52, respectively.

The upper support structure or endoskeleton 30, that includes the two opposing triframes 40 and 42 and the horizontal members 56, 58 and 60, can be covered by insect or mosquito bite prevention netting or screening shown at 70 that can be made from a fabric comprised, for example, from a fabric such as a woven cotton, a woven plastic material made from, for example, polyethylene, polyester, polypropylene, a nylon material or other man made yarns, threads, or strands comprised of a combinations of fibers. A mesh size within the woven fabric netting 70 of 1.2 mm will be sufficient to stop mosquitoes from entering, and a smaller mesh size, for example 0.6 mm, will be small enough to stop other biting insects, such as biting midges and "no-see-ums, from entering the screening. It should be understood that other mosquito screening materials could be used as well as what is important is to keep biting insects out of the bivy and away from biting contact with the bivy's occupant.

While the screening or netting 70 allows airflow through the bivy, it is also possible to also overlay a tarp, a cover, or a water proof sheet to create climate protection as desired. One example would be to have a tarp or a type of water proof sheet or cover, as is shown in dotted line at 72, that could be rolled along the top horizontal member 56 to which it could be held in that rolled up manner by a tie, by a Velcro connected strap, or a similar device. When unrolled such a tarp or cover would extend over the upper endoskeleton 30 including the two end triframes 40/42.

The size of the bivy 10 reasonably would conform to standard humanitarian aid and military, manufactured, cot and commercial or naval berth dimensions. As an example, the width of bivy 10 can vary between about 40 and about 55 inches, and preferably between about 24 and 36 inches, while the over all length of bivy 10 can vary from about 5.5 to about 7 feet and preferably can be about 87 inches long. The height of bivy 10, from floor member 12 to the top support 56 can range from about 20 to about 30 inches, and preferably is about 25 inches in over all interior height.

FIGS. 1-3 also show, for example, that the mosquito netting or screening can be provided with an entry portal 74 on one or both sides of bivy 10. That portal can be arranged in the form of an elongated U-shaped, two way entry zipper, positioned on a side of the bivy and for example below horizontal member 58 and above the floor 12. Preferably the zipper portal 74 should be able to be opened and closed from both the inside and outside so that the occupant can control entry and exit. It should be understood that other forms of entry portals 74 could also be used, for example, a Velcro closure, snaps, or other similar mechanisms.

The upwardly extending wall members 14-24, that define the outer periphery of floor 12, as well as each of the upper support structures comprised of members 44-60 can all be part of an inflatable structure or system formed from suitable hollow tubing. Each tubing cross point or interconnection, as for example at the apex of each of the triframes where members 44, 46 and 48 join one another, and where each triframe element joins the upwardly extending walls forming the outer periphery of floor 12, will comprise a joint or interconnection that fluidly interconnects each tube within the inflatable system. In a like manner the horizontal members 56, 58 and 60 will also fluidly interconnect with the triframes 40 and 42, with the top member 56 joining the apex of the opposing triframes, and with the side members 58 and 60 joining triframe members 46/52 and 48/54, respectively.

The individual tubes forming the straight members 44-60, as well as the tubes forming the upstanding walls 14-24 that extend around floor member 12, could be tubes having a diameter that might vary from about 2 inches to about 5 inches, with the preferred diameter being about 3 inches. Also, it is desirable to be able to deflate the bivy 10 and collapse the entire structure into a package that will have size and weight about equal to that of a football. Consequently, the collapsed package should weigh between 14-25 oz. with a preferred weight of about 1 pound (16 oz.).

Figure 5:
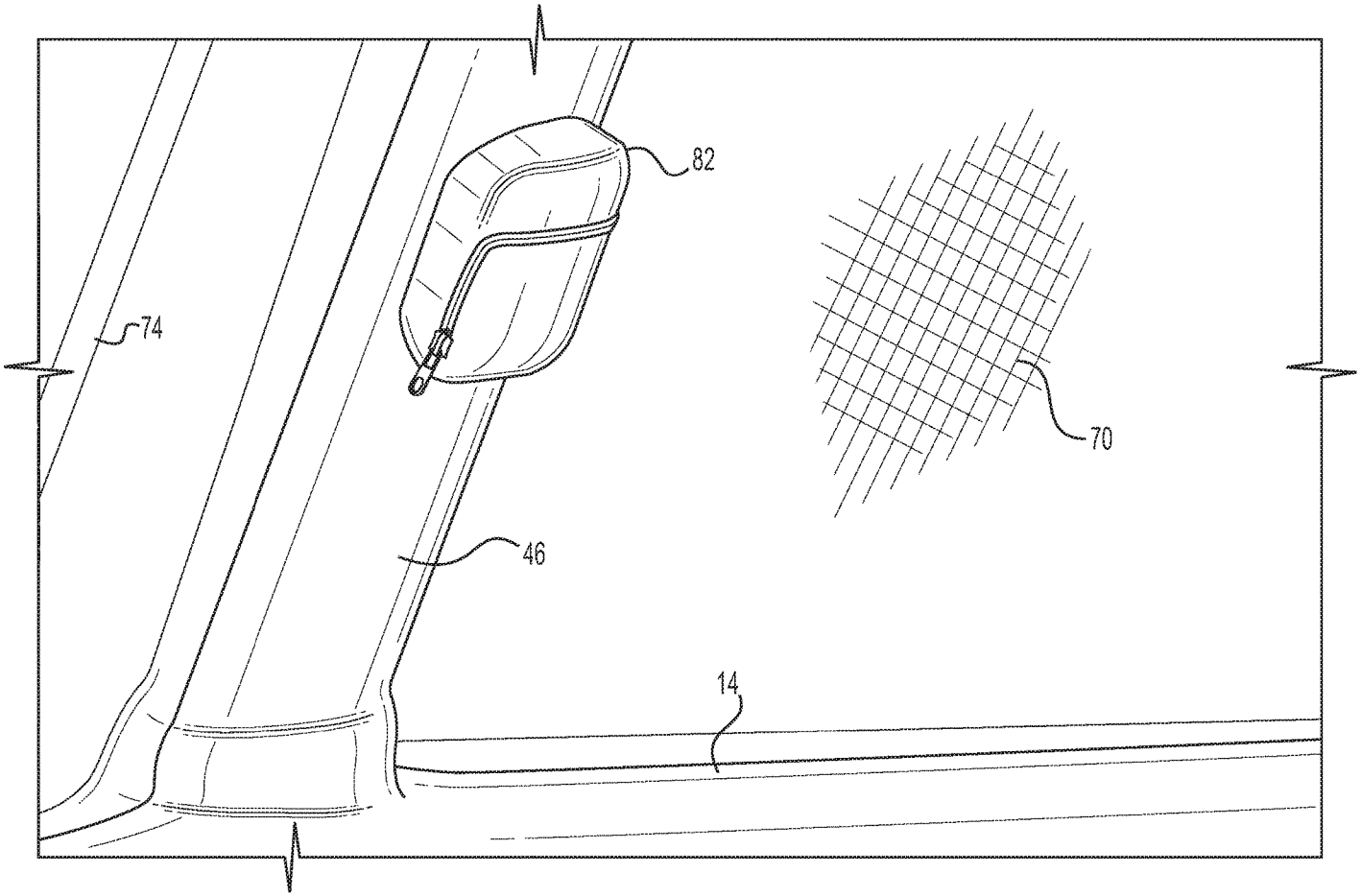
FIG. 5 is an enlarged view of an inflating arrangement inside the bivy.
Figure 6:
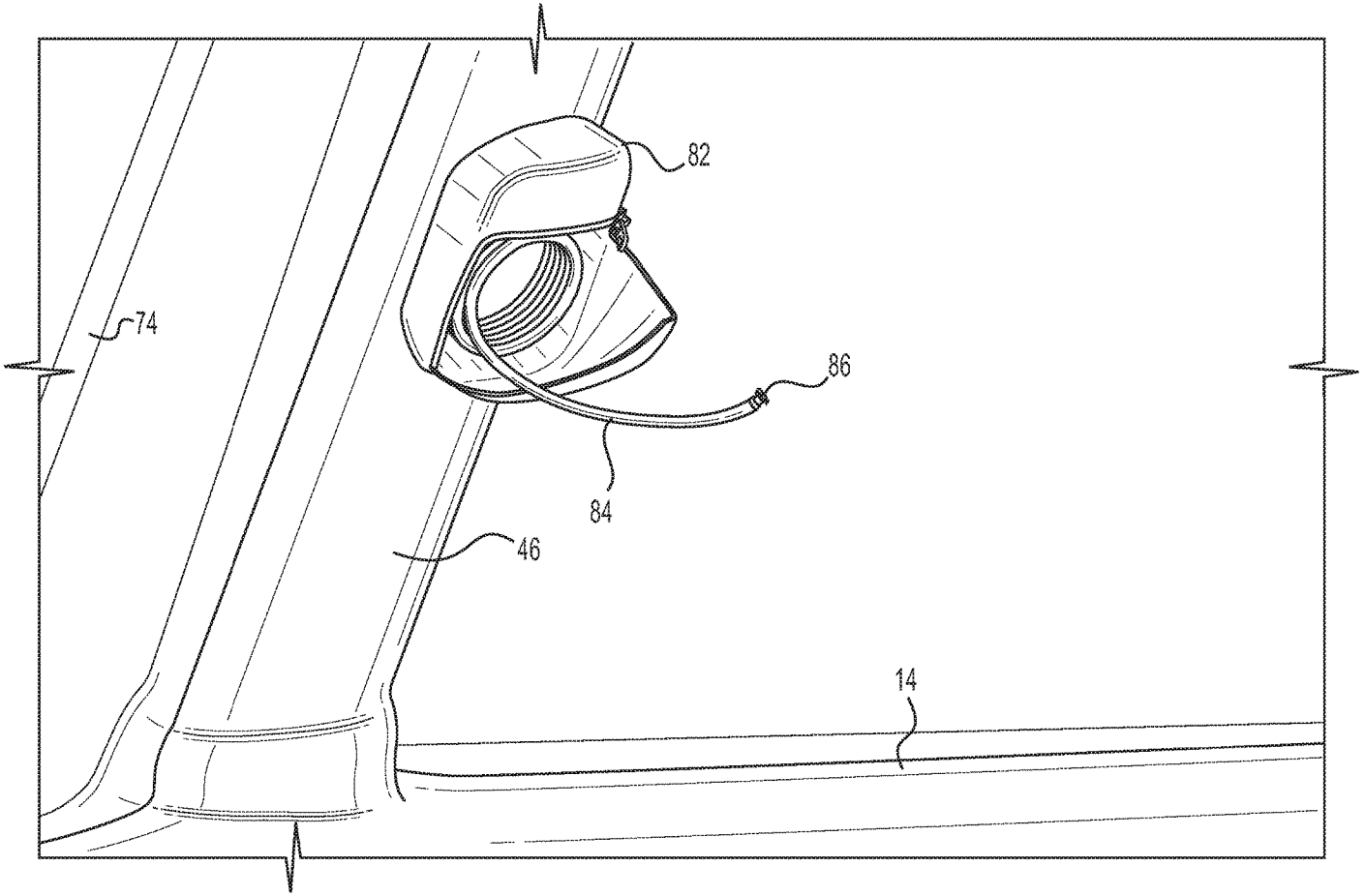
FIG. 6 is an elevational view of the inside inflator in a deployed condition.

As noted above there is an exterior inflation port 26 through which the entire endoskeleton 30 and the upstanding walls 14-24 can be inflated as a collective group. If the bivy is used where night air can be cold the inflated volume might partially deflate. To permit an occupant within bivy 10 to top up the inflation air volume, or to inflate or reinflate the inflatable system (members 14-60), an interior inflation port 80 can be provided, for example on the inside of triframe member 46 as is shown in FIGS. 5 and 6. Port 80 is preferably comprised of a pouch 82, a pull out tube 84 having a closure 86 at the end thereof to close off the outer end of tube 84. The bivy occupant can simply pull out tube 84 from pouch 82, remove or open the end closure 86 and blow into tube 84 to re-inflate or add supportive inflation into the inflatable system by mouth without exiting the bivy and exposing the occupant to bites. Additionally, a pump could be used with both the interior and exterior inflation ports 26/80.

Figure 7:
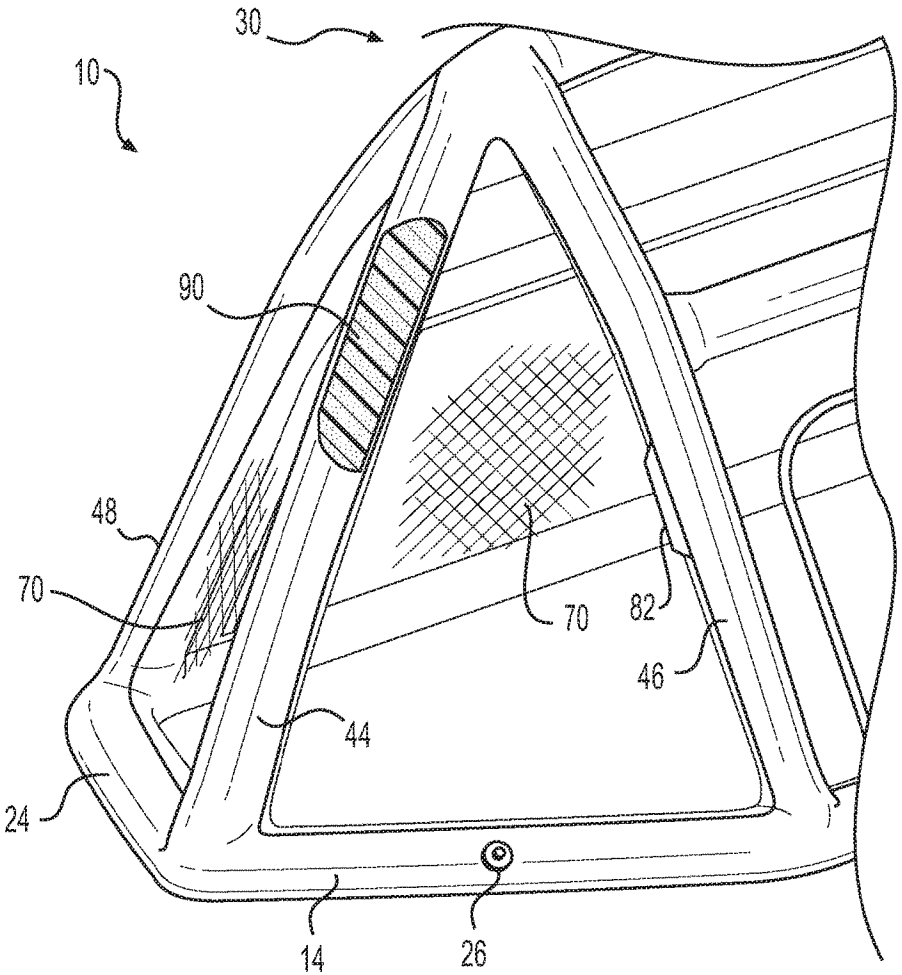
FIG. 7 is a partial perspective view of another embodiment of the present invention sowing use of a self rising foam.

Another exemplary alternative to inflating the endoskeleton or upper support 30 comprised of individual inflatable tube members 14-60, would be as shown in FIG. 7 where those tubes filled with a resilient, self inflating open cell foam 90 as shown by the portion of tube 44 that has been cut away. The foam could, for example, be polyurethane or plasticized polyvinylchloride foam, that will fill with air through an open inflation port 26. The outer tube, which can comprise an envelope for the foam, can be, for example, a coated nylon with a wall thickness that can vary between 0.0015 and 0.025 inches, a tube diameter that can vary between 2-6 inches, and the open cell foam can have a density that can vary between 0.5 and 5 pounds per cubic foot, and can be provided with an internal air pressure of from 3 to 20 psi via inflation port 26. The endoskeleton or upper support structure 30 and the upstanding walls 14-24 can all be compressed with air inflation port 26 being an open condition so that the foam filled tubes will be reduced in size and the while bivy can be collapsed into a small package that might be slightly heavier than that involving only the air inflatable tube system discussed previously.

Figure 8:
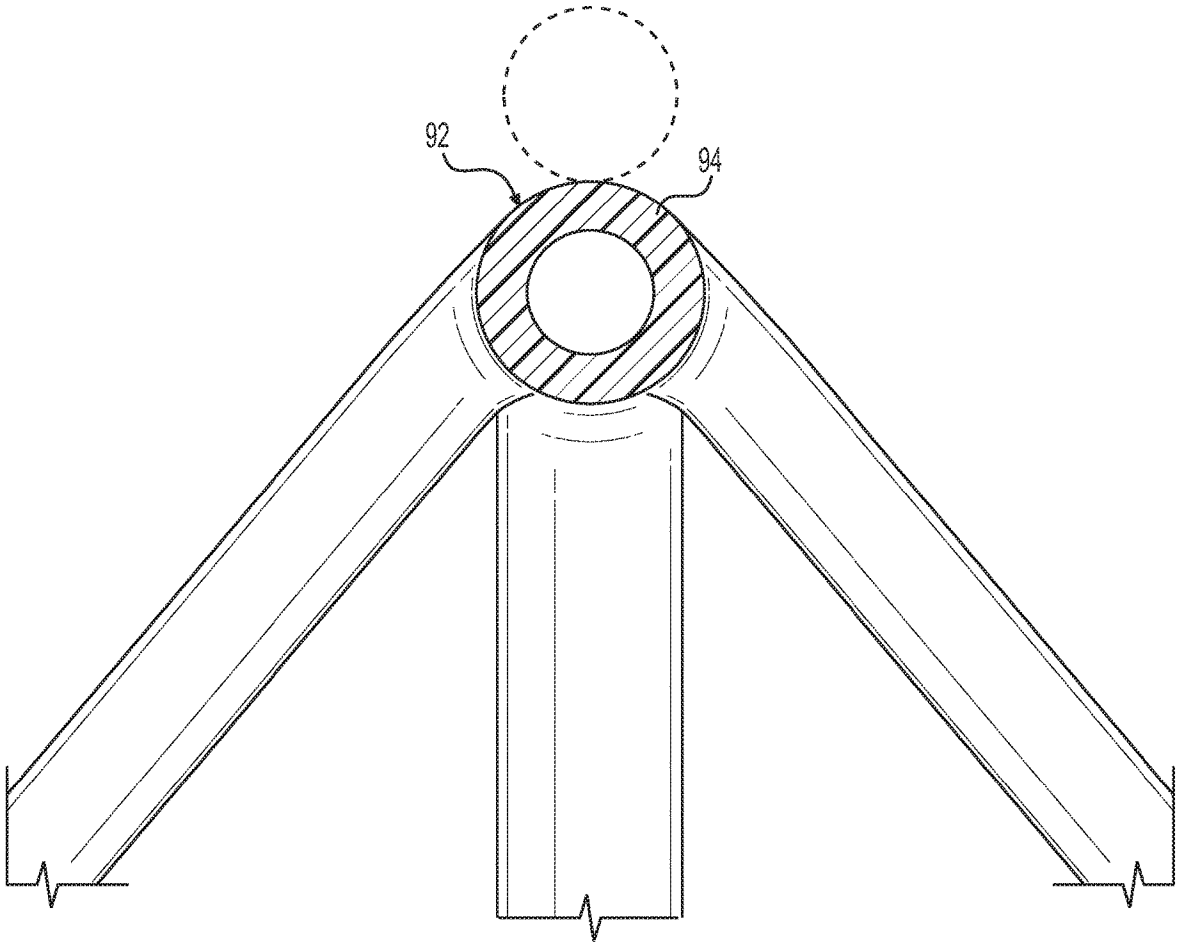
FIG. 8 a partial cross sectional view showing another embodiment of the present invention.

As another alternative, shown in FIG. 8, is achieved by having each of the members 14-60 in comprising the supporting and collapsible endoskeleton structure formed from an interconnected network of smaller diameter tubes 92, instead of the inflatable tubes of the previous embodiment of FIGS. 1-4. The tubes 92 will preferably have a thickened sidewall 94, as shown, for example whose thickness can be about one quarter to about one third of the total diameter, and with an overall tube 92 diameter of about 1 to 1.8 inches. When collapsed each of the tubes 92 will be bent and upon releasing the collapsed package the tubes 92 will each spring into a relatively straight condition and be strong enough to reform the endoskeleton and hold up the netting 70 and to remain in an erected condition until once again collapsed back into a small package.

As is evident from FIGS. 1-3 the triframes 40/42 at each end of the bivy 10 are formed from three straight members that define acute angles within the two triangles within each triframe 40/42. Looking at triframe 40, it is preferred that the uppermost angle between end member 44 and member 46 be about 30° , and that the angle at the bottom each of those members have with the outer periphery member 14 could then be 75° . Other angle combinations could, for example, include a top angle that could range between 30° and 50° with the bottom angles then both ranging between 75° and 65° . In general, as the top angle decreases the height increases, and the height would decrease as the top angle was enlarged, making the relationships inverse. It should be understood that other angles would be used as well with the foregoing range being the preferred range.

Figure 9:
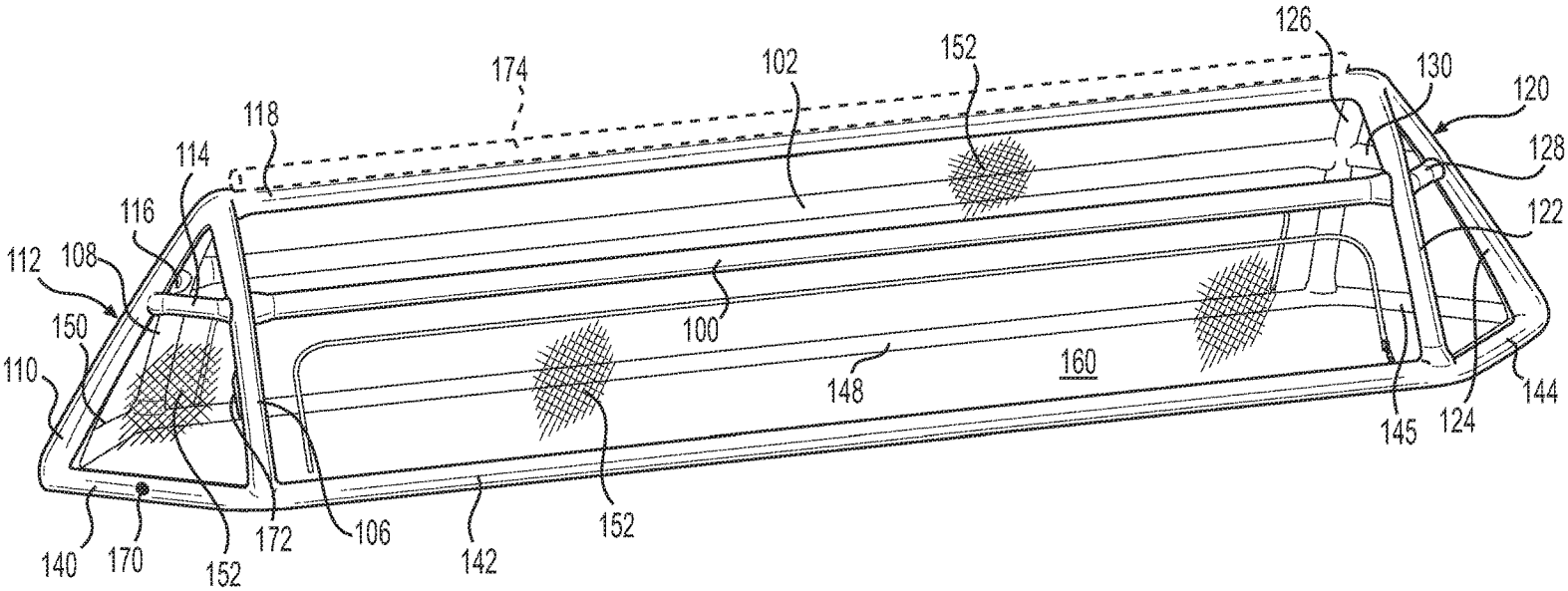
FIG. 9 is another embodiment of the present invention.

A further embodiment is shown in FIG. 9 that is also comprised of inflatable tubular members. Here the foremost triframe 112 includes side members 106 and 108 and an end member 110. This embodiment differs from the first embodiment by having the horizontal side members 100 and 102 extend beyond the sides of the triframe ends 106 and 108 on triframe 112 and interconnect with the end member 110 of triframe 112 by extension members 114 and 116. This same arrangement will also be provided at the opposite end triframe 120. That opposite end triframe 120 is itself comprised of side members 122 and 126 and an end member 124. The two extensions of horizontal side members 10 and 102 are shown at 128 and 130, respectively.

The bottom sheet 160 will be attached to and surrounded by edge members 140-150 that are also fluidly interconnected with triframes 112 and 120, and the horizontal side members 100, 102, 118 and extension members 114/116 and 28/130.

Thus, the horizontal side members 100/102 will effectively extend fully around the sides and each triframe and will be fluidly interconnected with the other inflatable tubes forming the upper endoskeleton support structure supporting netting material 152. Triframes 112 and 120 are interconnected by the horizontal side members 100/102 and by a top horizontal member 118. An inflating port 170 is also provided within an internal inflator pouch 172 like that shown in FIGS. 4 and 5. Also, a waterproof tarp shown in doted line at 174 could be provided as well.

D. Operation

To erect the bivy it can be unrolled or opened up from its collapsed condition. For the embodiment using the inflatable system, once the inflation port 26 is exposed the inflation system comprised of members 14-60 can be inflated into the form shown in FIG. 1. The mosquito netting or screening is adhered to the endoskeleton of the bivy so the inflation of that endoskeleton will automatically expand and arrange the netting and the entry port 72. To collapse an erected bivy 10 port 26 can be opened, along with port 86, and the bivy can be folded or rolled into a small package as the air is expelled from within the inflation system.

Where the endoskeleton tubing is filled with the self inflation open celled foam, once the collapsed package is opened and the inflation port 26, or port 86 as well, is opened the self rising foam will fill causing the endoskeleton to rise into its desired shape. It may be helpful to provide some additional air pressure by adding air into or through port 26 or 86. To collapse this embodiment the ports 26/86 can be opened and the bivy can once again be compressed, rolled or folded into a smaller package size with entrained air once again being expelled through ports 26/86 as the bivy is compressed into its smaller package size.

In the smaller tube version, the raised bivy can be folded, compressed or rolled into its smaller size with the tubes being bent and thus confined within the collapsed structure.

In each instance, the smaller collapsed structure and shape can be retained by an outer cover, by a tie, a snap, by a Velcro strap system, or any other approach that will securely yet releasably hold the bivy elements in their compressed, folded, rolled or collapsed form.

When introducing elements of various aspects of the present invention or embodiments thereof, the articles "a," "an," "the" and "said" are intended to mean that there are one or more of the elements, unless stated otherwise. The terms "comprising," "including" and "having," and their derivatives, are intended to be open-ended terms that specify the presence of the stated features, elements, components, groups, and/or steps, but do not exclude the presence of other unstated features, elements, components, groups, and/or steps and mean that there may be additional features, elements, components, groups, and/or steps other than those listed. Moreover, the use of "top" and "bottom," "front" and "rear," "above," and "below" and variations thereof and other terms of orientation are made for convenience, but does not require any particular orientation of the components. The terms of degree such as "substantially," "about" and "approximate," and any derivatives, as used herein mean a reasonable amount of deviation of the modified term such that the end result is not significantly changed. For example, these terms can be construed as including a deviation of at least +/−5% of the modified term if this deviation would not negate the meaning of the word it modifies.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An anatomically configured insect bivy comprising:

a floor member having a bottom portion and an outer periphery;

opposing pyramidal tri-frame end supports each having an upper end, and a lower end connected to the floor member;

a first horizontal member extending between and directly interconnecting the upper ends of each of the opposing pyramidal tri-frame end supports;

a crimped area formed at each of an opposite end of the first horizontal member that will crimp opposing ends of the first horizontal member upon a partial deflation to entrap inflating air within the first horizontal member to thereby assist in preventing sagging of the opposing pyramidal tri-frame end supports;

insect netting operatively interconnected to the opening end supports, the first horizontal member, and to the floor outer periphery and having an entry portal provided therein; and wherein each of the floor member outer periphery, the opposing pyramidal tri-frame end supports, and the first horizontal member comprises self-rising structures that when raised collectively form the bivy into an interconnected structure that will closely enclose but be spaced an anatomical shape of an individual.

2. The insect bivy as in claim 1 wherein the opposing end supports, the first horizontal member, the horizontal side members and the outer periphery of the floor member further include fluidly interconnected, inflatable portions, and at least one inflation port for inflating and deflating the inflatable portions.

3. The insect bivy as in claim 2 further including an additional inflation port accessible from within a raised insect bivy.

4. The insect bivy as in claim 1 wherein the floor member is waterproof.

5. The insect bivy as in claim 1 wherein the bivy is collapsible into a releasable, compressed package.

6. The insect bivy as in claim 1 wherein the self-rising structure comprises a tubular encased self-rising foam.

7. The insect bivy as in claim 1 wherein the self-rising structures comprises a series of interconnected spring force creating tubular members.

8. The insect bivy as in claim 1 wherein the entry portal comprises a portion of the netting that is open and closable from inside and outside of the insect bivy.

9. The insect bivy as in claim 8 wherein the entry portal includes a zipper.

10. The anatomically configured insect bivy as in claim 1 further including a horizontal side member positioned on each of two opposite sides of the first horizontal member, with one of the horizontal side members directly interconnecting the opposing pyramidal tri-frame end supports on one of two opposite sides of the insect bivy, and with the other of the horizontal side members interconnecting the opposing end supports on the other of the two opposite sides of the insect bivy.

11. An individual insect bivy comprising:

a floor member having a bottom portion and an outer periphery;

opposing end supports each comprised of a triframe having a first center member and second and third side members, the first center member and the second and third side members each having an upper end, the upper end of the first center member being interconnected with the upper end of each of the second and third side members so as to define an acute angle therewith at a top of the triframes, each of the first center member and the second and third side members having an opposite end connected to the floor member;

a first horizontal member extending between and interconnecting the top of each of the triframes;

wherein the opposing end supports, the first horizontal member and the outer periphery of the floor member further include fluidly interconnected, inflatable members, and at least one inflation port for providing air into and deflating air from the inflatable members;

insect netting operatively interconnected to the opposing end supports, the first horizontal member and to the floor outer periphery and having an entry portal provided therein, with the opposing end supports, the first horizontal member and to the floor outer periphery comprising inflatable structures that when raised collectively form the bivy into an interconnected structure that will closely enclose but be spaced from an anatomical shape of an occupant; and a crimped area formed at each of an opposite end of the first horizontal member that will crimp opposing ends of the first horizontal member upon a partial deflation to entrap inflating air within the first horizontal member to thereby assist in preventing the opposing end supports from sagging and keep the insect netting from touching the occupant's skin.

12. The insect bivy as in claim 11 wherein the inflatable members comprise self-rising structures.

13. The insect bivy as in claim 11 wherein the bivy is collapsible into a releasable, compressed package.

14. The individual insect bivy as in claim 11 further including a horizontal side member positioned on each of two opposite sides of the first horizontal member, with one of the horizontal side members directly interconnecting the opposing end supports on one of two opposite sides of the insect bivy, and with the other of the horizontal side members interconnecting the opposing end supports on the other of the two opposite sides of the insect bivy.

15. An individual, anatomically structured insect bivy comprising:

a floor member having a bottom portion and an outer periphery;

opposing end supports connected to the floor member;

a first horizontal member extending between and interconnecting a top of each of the opposing end supports;

the opposing end supports and the first horizontal member collectively forming an upper support structure;

insect netting operatively interconnected to the upper support structure and to the floor member and having an entry portal provided therein;

wherein the upper support structure and the outer periphery of the floor member further include fluidly interconnected, inflatable members, and at least one inflation port for providing air into and deflating air from the inflatable members;

the insect bivy further including a crimped area formed at each of an opposite end of the first horizontal member that will sufficiently crimp opposing ends of the first horizontal member upon a partial deflation to thereby entrap inflating air within the first horizontal member to thereby assist in preventing the upper support structure from sagging; and the upper support structure, the floor member, and the floor member outer periphery collectively forming the insect bivy into an interconnected raised structure that will closely enclose but be spaced from an anatomical shape of an individual.

16. The insect bivy as in claim 15 further including a horizontal side member positioned on each of two opposite sides of the first horizontal member, with one of the horizontal side members interconnecting the opposing end supports on one of two opposite sides of the insect bivy, and with the other of the horizontal side members interconnecting the opposing end supports on the other of the two opposite sides of the insect bivy.

17. The insect bivy as in claim 15 wherein the inflatable members comprise self-rising structures.

* * * * *